United States Patent [19]

Boushey

[11] 4,112,404

[45] Sep. 5, 1978

[54] VARIABLE FLUX TRANSFORMER

[76] Inventor: Homer A. Boushey, 235 Golden Oak Dr., Portola Valley, Calif. 94025

[21] Appl. No.: 731,133

[22] Filed: Oct. 12, 1976

[51] Int. Cl.[2] ..... H01F 21/06

[52] U.S. Cl. ..... 336/133; 336/30; 336/135

[58] Field of Search ..... 336/130, 132, 133, 134, 336/135, 30; 323/51

[56] References Cited

U.S. PATENT DOCUMENTS

| | | | |
|---|---|---|---|
| 1,227,844 | 5/1917 | Simon | 336/133 X |
| 1,756,875 | 4/1930 | Montsinger | 336/135 X |
| 2,460,922 | 2/1949 | Candy | 336/135 |
| 3,152,311 | 10/1964 | Bojarski | 336/135 X |
| 3,260,975 | 7/1966 | Howard | 336/133 |
| 3,716,719 | 2/1973 | Angelery et al. | 336/134 |

FOREIGN PATENT DOCUMENTS

| | | | |
|---|---|---|---|
| 79,383 | 9/1950 | Czechoslovakia | 336/135 |
| 426,100 | 11/1911 | France | 336/135 |
| 777,638 | 12/1934 | France | 336/134 |
| 860,233 | 12/1952 | Fed. Rep. of Germany | 336/135 |
| 431,304 | 2/1948 | Italy | 336/133 |
| 9,838 of | 1908 | United Kingdom | 336/135 |

*Primary Examiner*—Thomas J. Kozma
*Attorney, Agent, or Firm*—C. Michael Zimmerman

[57] ABSTRACT

Several embodiments of a variable flux transformer are described which are quite simple in design and yet provide a greater range of adjustment of the output emf than prior art arrangements. Each transformer includes a core of a magnetic flux-conductive material having three legs extending from a common cross bar, which legs terminate at free ends which are spaced from one another. A primary electrical coil is interactively associated with one of the legs, and a secondary electrical coil is interactively associated with another leg. The third leg is used to complete a magnetic flux path from the primary coil leg bypassing the secondary coil leg. A magnetic flux control switch which is also of magnetic flux-conductive material is positioned at the free ends of the legs for appropriately bridging the spacings therebetween to complete only those low reluctance flow paths between such legs desired at any given time.

2 Claims, 7 Drawing Figures

VARIABLE FLUX TRANSFORMER

BACKGROUND OF THE INVENTION

The present invention relates to variable flux transformers and, more particularly, to such a transformer which enables the magnetic coupling between the primary and secondary electrical coils of the transformer to be finely adjusted between a maximum coupling and an essentially zero coupling and yet is simple in design, manufacture and operation.

Variable flux transformers have long been available for use in situtations in which it is desired that the electromotive force (emf) output of a transformer be variable relative to its emf input. Typically such a transformer is designed to allow adjustment of the magnetic coupling between its primary and secondary electrical coils, i.e., adjustment of the amount of the magnetic flux generated by the primary coil which can interact with a secondary coil to generate an output emf. Since the value of such output emf will be directly dependent upon the flux flow change responsible for the same, the result is that the electrical output of the secondary can be correspondingly varied.

For various reasons, presently available variable flux transformers are not suited for many uses in which their function is desirable. For example, most transformers of this type now available are relatively expensive due to intricacies involved in manufacturing the same. The magnetic core which ties together the primary and secondary coils is often manufactured in separate pieces on which the coils are individually spun wound and which then must be assembled to achieve good magnetic flow therebetween. That is, the core of many variable flux transformers has a configuration which prevents the coils from being installed thereon without a bobbin after the core is constructed. This is a relatively expensive coil winding technique. Most transformer manufacturers therefore believe it necessary to manufacture a variable flux transformer core in separate pieces which have coils wound thereon and then must be joined with a joint that does not hinder good magnetic flux flow. Another problem with many variable flux transformers is that they also do not provide sufficient or efficient variation in flux coupling for potential uses requiring low values of secondary emf. In this connection, most variable flux transformers use a bypass path or magnetic route to accommodate flux generated by the primary coil which is not to be passed by the secondary coil. In most of such designs the secondary remains at all times magnetically coupled to the primary through, for example, a magnetic circuit which is parallel to the bypass circuit. The result is that when low secondary emf is desired and the bypass path is selectively closed for good magnetic flow to accommodate the full amount of the flux generated by the primary, some flux will still flow through the secondary parallel circuit to interact with the secondary coil and induce a small unwanted electromotive force. This unwanted emf has prevented selection of low secondary emf outputs with any accuracy. While some designs allow the secondary magnetic circuit to be opened completely and thus avoid this problem, these designs invariably merely transfer both the parallel bypass circuit and the accuracy problem to the maximum secondary emf output condition of the transformer.

SUMMARY OF THE INVENTION

The present invention is a variable flux transformer of a design which is simple to manufacture and operate and yet avoids the problems associated with a parallel magnetic bypass circuit. In its basic aspects, the transformer includes a transformer core of a magnetic flux-conductive material having at least three legs extending from a common cross bar which terminate at free ends spaced from one another. A primary electrical coil is interactively associated with one of the legs, and a secondary electrical coil is interactively associated with a second one of said legs. The third core leg is a bypass leg for magnetic flux, and the transformer includes a magnetic flux path control switch also of a magnetic flux-conductive material, positioned at the free ends of the core legs for selectively bridging the spacing therebetween to complete desired low reluctance flow paths between the first leg and either or both of the second and third legs.

Because the primary and secondary electrical coils are on legs which have free ends, rather than mounted in a closed transformer core, the core can be completely fabricated prior to the installation of such electrical coils. That is, each of the coils can be slipped onto its associated leg from the leg's free end, assuming that the leg is of a cross-sectional area and shape accommodating such assembly. Moreover, the control switch can be designed and mounted for movement relative to the ends of the legs to a position in which the primary coil leg is not coupled at all with the secondary coil leg but only with the bypass leg. The secondary coil leg is thus completely removed from the magnetic circuit of which the primary coil leg is a part, with the result that no emf due to such a magnetic circuit coupling will be generated.

The invention includes other features and advantages which will be described or will become apparent from the following more detailed description of the preferred embodiments.

BRIEF DESCRIPTION OF THE DRAWING

With reference to the accompanying four sheets of drawing.

DETAILED DESCRIPTION OF THE PREFERRED EMBODIMENTS

Figure 1:
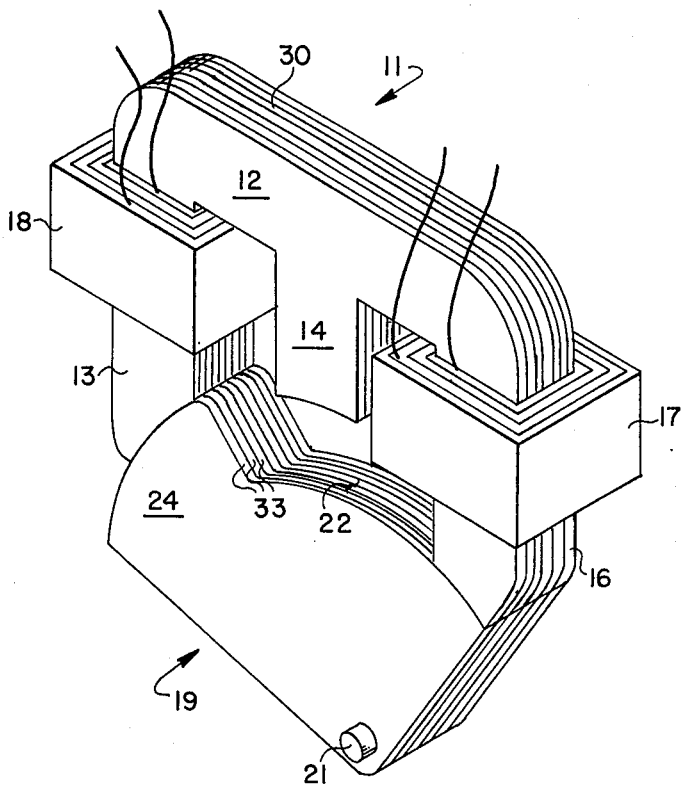
FIG. 1 is an isometric view of a preferred embodiment of the invention.
Figure 2:
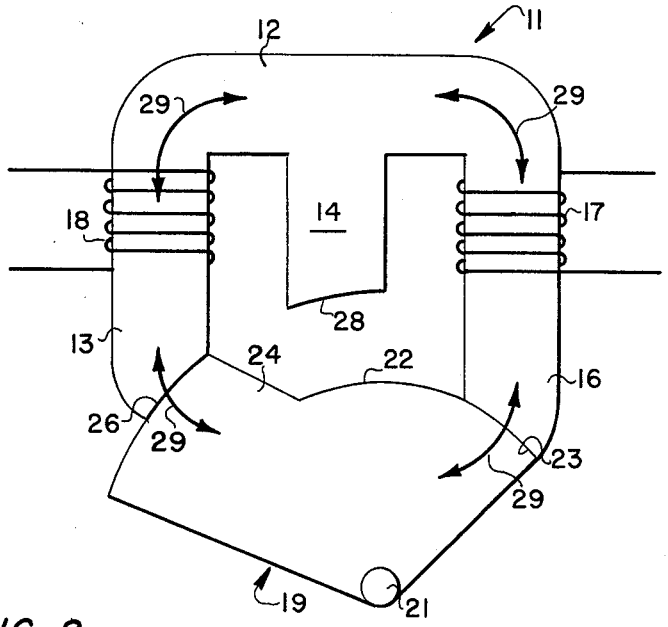
FIGS. 2 and 3 are schematic side elevation views of the preferred embodiment of FIG. 1 illustrating the control switch for magnetic flux in different positions.
Figure 3:
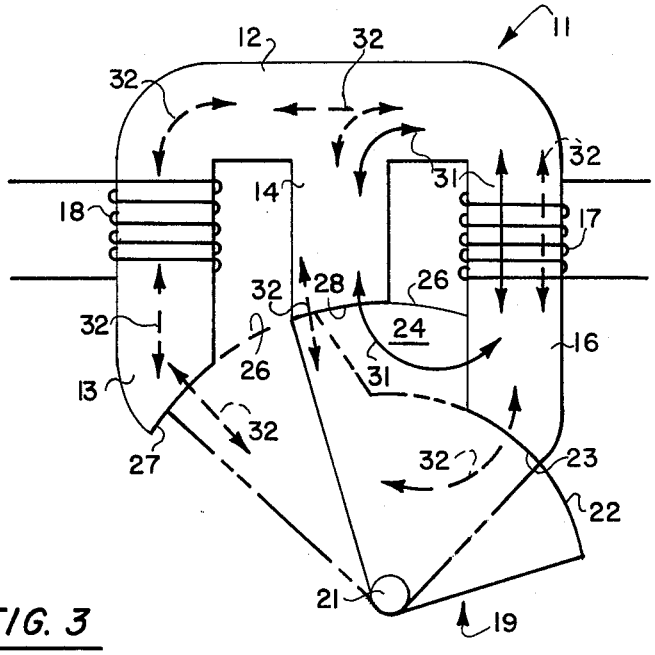

Reference is first made to FIGS. 1 through 3 which illustrate a preferred embodiment of the variable flux transformer of the invention, FIGS. 2 and 3 schematically illustrating different positions of the control switch of such transformer.

The transformer of FIGS. 1–3 includes a transformer core, generally referred to with the reference numeral 11, made of a magnetic flux-conductive material, such as from one of the iron alloys sold for this purpose. Core 11 includes a cross bar 12 from which three parallel and spaced apart legs 13, 14 and 16 extend. As illustrated, the legs 13–16 all extend from the same side of cross bar 12 to form therewith a transformer core having substantially an "E" shape with the legs terminating at free ends which are spaced from one another.

A primary electrical coil in the form of a winding 17 surrounds a first one of the legs, leg 16, and a secondary electrical coil in the form of a winding 18 surrounds a second one of such legs, leg 13. The primary coil 17 is for the purpose of generating magnetic flux in the transformer core, and an electromotive force (emf) is induced in secondary coil 18 upon flow of flux through leg 13.

The transformer also includes a magnetic flux path control switch, generally referred to by the reference numeral 19, positioned at the free ends of the legs 13–16 for bridging the spacing therebetween to complete low reluctance flow paths for magnetic flux. In this connection, the switch 19 is mounted for rotary movement on an axle 21 and is shown at extreme end positions in FIG. 2 and in solid in FIG. 3. Switch 19 includes a cylindrical contacting surface 22 whose axis is coextensive with the axis of axle 21. The free end of leg 16, the leg having the primary winding 17, extends to a location beyond the terminus of the legs 13 and 14 and has a concave cylindrical surface 23 which rides on switch surface 22 to maintain flux path contact between the leg and the switch throughout movement of such switch between its extreme positions.

Switch 19 also includes a lobe extension 24 which provides contact between the same and the free ends of legs 13 and 14. More particularly, extension 24 has a cylindrical contacting surface 26 which mates with corresponding contacting surfaces 27 and 28 at the respective free ends of the legs 13 and 14. All of such contacting surfaces are cylindrical sections having axes which are coextensive with the axis of axle 21 so as to maintain good contact between the switch 19 and the legs 13 and 14 when such surfaces are adjacent one another.

It should be noted that the contact surface 22 of the switch is at a significantly shorter radial distance from the axle 21 than is the contacting surface 26. This constructional feature is made possible by the spacing of the position of the axle 21 and, hence, the axis of rotation of the switch, closer to the free end of leg 16 than to the free end of the legs 13 and 14. Such arrangement is partially responsible for a minimization of flux leakage when the switch is in its extreme end positions, as will become apparent below.

As mentioned previously, switch 19 is selectively movable by rotation from the extreme end position shown in FIG. 2 to the extreme end position shown in solid in FIG. 3. When the switch is in the position shown in FIG. 2, all of the magnetic flux generated in leg 16 by the passage of alternating current through the coil 17 is directed by such switch into the leg 13 for inductive interaction with the coil 18. This flow is represented in FIG. 2 by the arrows 29. The result is that the emf generated in coil 18 will be the maximum emf which can be generated by the transformer.

It should be noted that when the switch is in the position shown in FIG. 2, a relatively great distance exists between the leg 14 and the switch 19 with the result that essentially no leakage loss through the bypass leg 14 occurs. The size of this spacing is partially due to the switch contacting surface 22 being a cylindrical section which is closer to the axis of rotation than the cylindrical section of switch contacting surface 26.

When the path control switch is in the extreme position shown in solid in FIG. 3, all flux generated in the leg 16 is diverted through the bypass leg 14. That is, the switch 19 completes a closed path loop between the leg 16 for the flow of such flux as represented by the solid line arrows 31. As a particularly salient feature of the invention, it is to be noted that when the switch 19 is in such position, there is no closed-loop low reluctance magnetic path passing interactively by both the primary and secondary coils 17 and 18. And because of the large air gap between the end of leg 13 and the control switch 19, there is essentially no flux generated by coil 17 flowing in leg 13 interactively by the coil 18 to induce unwanted emf in the latter coil. The transformer of the invention therefore provides at this extreme position more complete reduction of flow of flux by the coil 18 than do prior art arrangements in which the bypass path is maintained at all times in parallel with the secondary coil.

Between the extreme end positions represented by the showing in FIG. 2 and the solid showing in FIG. 3, there is an infinite number of successive positions of the flux control switch diverting differing amounts of flux generated in the leg 16 through the legs 13 and 14. One of such positions is illustrated in phantom in FIG. 3. As shown by the dotted line paths 32 therein, the flux is divided for flow through both of the legs 13 and 14. In this connection, the amount of flux which will flow along any one path through the flux-conductive material is limited by the smallest cross-sectional area of the material along such path. It will be seen that when the switch is in the phantom position illustrated in FIG. 3, the smallest cross-sectional area along either of the paths through the legs 13 and 14 is determined by the portion of the switch collecting surface 26 which is in contact with the contacting surfaces 27 and 28 of the respective leg.

The value of the emf induced in the coil 18 is directly dependent upon the amount of flux which passes interactively thereby. Thus, the value of emf induced in the coil 18 when the control switch is in the phantom position shown in FIG. 3 is significantly less than the value of emf induced in such coil when the switch is in the position shown in FIG. 2. It will be recognized, though, that when control switch 19 is moved from the position illustrated in phantom clockwise, for example, to a position in which its contact surface 26 is simultaneously less in contact with the surface 27 of leg 13 but more in contact with the surface 28 of leg 14, a greater amount of the flux generated in the leg 16 will be diverted through the bypass leg 14. The result will be that less flux will flow through the leg 13 and interactively by the coil 18 to generate an emf therein. Thus, the value of the output emf can be varied as desired by changing the position of switch 19.

Most desirably, both the transformer core and the flux path control switch are of laminated construction in order to reduce magnetic flux losses due to eddy currents. The laminae making up the core are referred to in FIG. 1 by the reference numeral 30, whereas the laminae making up the control switch are referred to in such figure by the reference numeral 33. It should be noted that the laminae in each body are all parallel to the plane of magnetic flux flow through the body. The simple, planar construction of the core and control switch is quite conducive to such a laminated construction. That is, both the core and the control switch are respectively made up by pluralities of identical lamina which may be, for example, stamped from the flux-conductive material. Machining, if required at all, is only required for the contacting surfaces at the ends of the core legs and corresponding contacting surfaces on the control switch. To facilitate good flux flow between the two bodies, the laminations of the transformer core are parallel to the laminations of the switch at the contacting surfaces.

The simplicity of the transformer core design also simplifies the installation of the primary and secondary electrical coils on the same. That is, before the flux control switch is mounted in place, it is a simple matter to install each pre-wound coil on the core after the same is completely constructed merely by sliding the coil over the free end of its associated core leg to the desired location. In this connection, each of the legs has a cross-sectional area in shape from its free end to the location of the coil accommodating such method of assembly. To facilitate a close fit of each of the coils with its associated leg while permitting sliding movement therebetween during assembly, it is preferred that each of the legs 13 and 16 is made to taper inwardly slightly toward its free end. The coil associated therewith can then be easily slipped over such free end to the desired location at which it binds on the leg for secure positioning. Of course, in accordance with general practice, each of the coils should be wrapped with insulation or otherwise electrically insulated before being installed to prevent the same from short-circuiting with the core during operation of the transformer.

It should be noted that if desired each of the coils could be pre-wrapped on a collar which then is slid on the leg associated with such coil. Such a collar could be provided with a cylindrical outer periphery on which the coil is wrapped, and a square or rectangular inner periphery for mating with the leg over which it is slipped. The collar should also be of a magnetic flux-conductive material, such as of a sintered iron alloy. In this connection, although the cores and the switches of the preferred embodiments are made of laminations, it will be recognized that either or both could as well be of a cast or machined, sintered or solid material.

Figure 4:
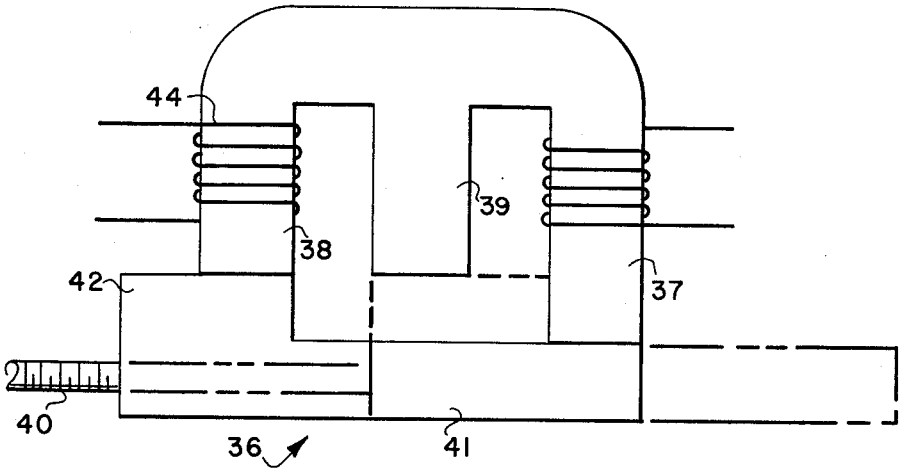
FIG. 4 is a schematic side elevation view of another preferred embodiment of the invention illustrating the control switch thereof in two different positions.

There are other configurations of variable flux transformers which can incorporate the features of the instant invention. For example, there is shown in FIG. 4 an embodiment of the invention in which the flux control switch is mounted for translational movement rather than rotary movement. That is, with reference to such figure, the control switch 36 of such embodiment is a slide mounted for translational movement horizontally between one extreme position shown in solid in such figure and another extreme position shown in dotted lines. A first one of the core legs, leg 37 of the transformer core, terminates at a location beyond the terminus of the other two legs 38 and 39, and the control slide includes a contact arm 41 which maintains flux path contact with the free end of leg 37 during movement of the slide through its positions. The control slide further includes a slide lobe 42 which is in flux communication with the contact arm 41, and provides flux path contact with the legs 38 and 39. The secondary coil 44 is on the leg 38 and the leg 39 is the bypass path leg. Operation of the embodiment of FIG. 4 is basically the same as the operation of the embodiment in FIGS. 1–3 except that instead of relying on rotary motion of the control switch, translational motion of such switch provides adjustment of the amount of flux which flows through the secondary coil. The slide control switch provides the same accurate adjustment of the amount of magnetic flux which flows through the coil 44 as does the rotary switch of the earlier described embodiment. That is, when the slide is in the position shown in phantom, virtually no unwanted emf will be induced in coil 44. Moreover, the coils can be installed on the core of this embodiment as easily as on the core of the previously described embodiment. And both the core and switch are conducive to manufacture from laminae in the same manner.

Figure 5:
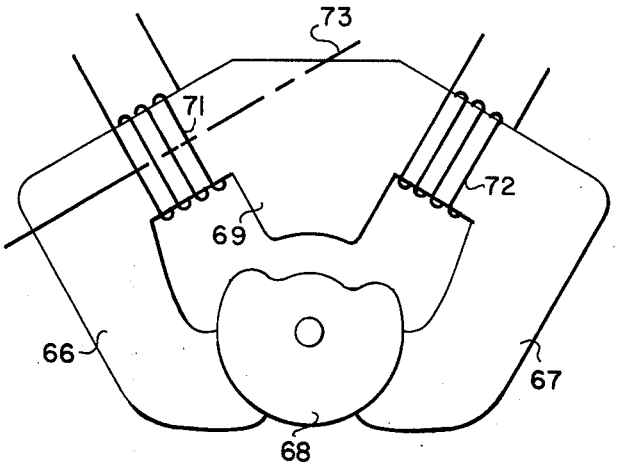
FIG. 5 is a schematic side elevational view of a third preferred embodiment of the invention.

FIG. 5 illustrates another embodiment of the invention having a control switch of reduced mass. With reference to such figure, it will be seen that the free ends of the outer legs 66 and 67 of the transformer core terminate at positions on the side of the switch 68 opposite that on which the free end of the center leg, leg 69, terminates. That is, switch 68 is discoidal in shape and the free ends of the legs 66, 67 and 69 terminate spaced from one another around the full periphery of such switch on both sides of any diametrical plane which extends therethrough. Thus, substantially the full periphery of such discoidal switch is used as a contacting surface, thereby reducing the mass of such discoidal switch necessary to provide the contacting surfaces.

While rotary control switch 68 is generally discoidal in shape, it is provided with a concave indent 74 which enables the switch to provide the desired selective formation of magnetic flux flow paths. In this connection, the indent 74 has a width greater than the individual widths of each of the legs 67 and 69 as illustrated to provide a gap between such switch and the appropriate one of such legs when the switch is in its respective extreme positions.

As will be noted, the primary and secondary electrical coils 71 and 72 respectively of the embodiment shown in FIG. 5 are positioned beyond right angle corners in their associated legs which will prevent such coils from being inserted to their proper positions from the free ends of the legs. The geometry of the embodiment, however, facilitates the wrapping of the coils in position. That is, before the switch 68 is installed in its location, a straight-line open gap exists through the core configuration transversely to the locations for the coils facilitating the winding of the same about axes which coincide with the core legs at this coil position. To facilitate understanding of this, one of the axes is shown in the drawing and is referred to by the reference numeral 73. In all other respects the embodiment of FIG. 5 incorporates the previously described features of the instant invention.

Figure 6:
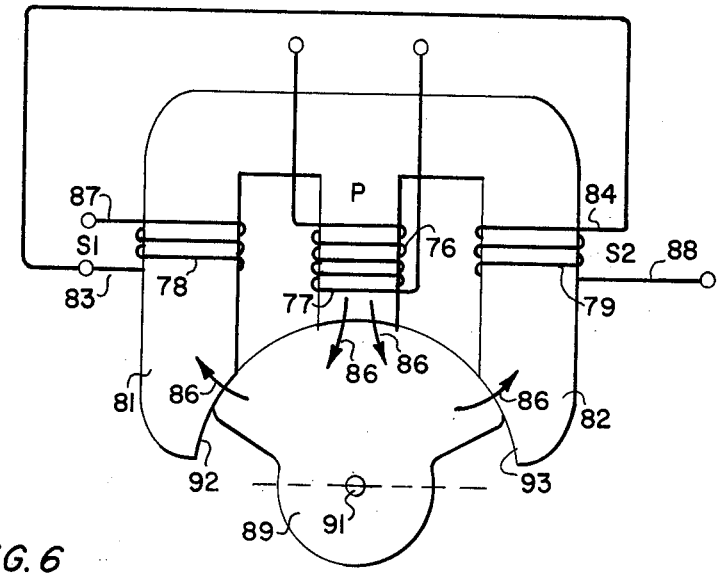
FIG. 6 is a schematic side elevational view of a differential transformer embodiment of the invention.

The invention is also applicable to so-called differential transformers of the type which find use in various measuring devices. Such a transformer is a variable flux transformer having two secondary coils connected in series opposition, rather than only one secondary coil. Reference is made to FIG. 6 which shows a differential transformer incorporating the invention. The primary electrical coil 76 of such embodiment is wrapped around the center leg 77 of the transformer core, and the two secondary coils 78 and 79 are respectively interactively associated with the outer legs 81 and 82 of such core. Thus, the bypass leg in this embodiment has a second secondary coil interactively associated therewith.

The secondary coils 78 and 79 are connected serially in opposition to one another. That is, the terminal 83 of the coil 78 is connected to the opposite terminal 84 of the coil 79. Thus, upon the generation by the primary coil 76 of magnetic flux in the transformer core flowing in one direction at any given time, such as the direction indicated by arrows 86, opposing emfs will be generated in the coils 78 and 79 so that the output emf appearing across the terminals 87 and 88 will represent the difference between the emf's induced in the two secondary coils by the magnetic flux flow.

A magnetic flux path control switch 89 is provided at the free ends of the legs 81, 77 and 82 to vary the relative amount of the total flux which is diverted through the legs 81 and 82. That is, rotation of such switch about its axle 91 will vary the relative cross-sectional areas of the leg contacting surfaces 92 and 93 which are communicated with the pole 77. This will, in turn, vary the relative amount of emf generated in each secondary coil. Thus, when the flux passed interactively by the secondary coils 78 and 79 is equal, the induced emf's will be equal with the result that no potential difference will appear across the output terminals 87 and 88. When the magnetic flux passing by one of the coils 78 and 79 is not equal to the flux passing by the other, there will be a potential difference at the terminals 87 and 88, which potential difference will be proportional to the difference in such flux flow. Moreover, the phase of any current flow due to such potential difference will depend on which of the coils 78 or 79 has the greater emf induced therein. That is, the phase of current due to a potential difference caused by the emf induced in coil 78 being less than that induced in coil 79 will be 180° out-of-phase with current produced due to the emf induced in coil 79 being less than that induced in coil 78.

Besides the above, the embodiment of FIG. 6 corresponds to the earlier embodiments and incorporates all broad features of the instant invention.

Figure 7:
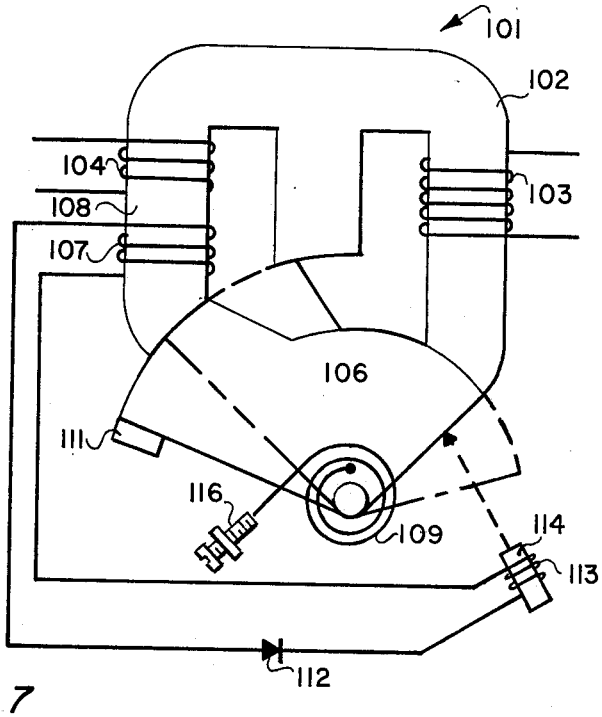
FIG. 7 is a schematic side elevational view of a preferred embodiment of the invention providing automatic voltage regulation.

FIG. 7 illustrates another preferred embodiment of the invention providing automatic regulation of the output of the secondary. The transformer, generally referred to by the reference numeral 101, includes a core 102, a primary electrical coil 103, a secondary electrical coil 104, and a flux control switch 106, conforming generally to the corresponding parts of the embodiment of FIGS. 1 through 3. It further includes means for sensing the amount of electromotive force generated at any given time in the secondary coil. More particularly, a sensing electrical coil 107 is provided along with the secondary coil 104 on the secondary core leg 108. Thus, any magnetic flux flow change in leg 108 which induces an emf in the secondary coil will also induce an emf in the sensing coil, which emf will be proportional to the secondary coil emf. Motion producing means are included responsive to a change in the emf induced in the sensing coil by changing the positioning of the flux control switch. In this connection, the flux control switch is normally urged by a coil spring 109 into the position illustrated in solid against the stop 111 in which it couples all of the magnetic flux produced in the core by the primary coil 103 with the secondary leg 108. Sensing coil 107 is connected through a rectifier, schematically represented by the diode 112, with a solenoid coil 113. As illustrated, a plunger 114 whose position is controlled by the solenoid 113 is connected with the switch 106 to rotate the same. Solenoid 113 is oriented to retract plunger 114 in response to an increase in the amount of emf induced in the sensing coil, with the result that switch 106 will be urged to rotate in the clockwise direction. It will be recognized that when the emf induced in the sensing coil and, hence, the electromotive force generated by the solenoid 113, is sufficiently great to overcome the pressure of spring 109, switch 106 will be rotated by the plunger 114 to allow a portion of the magnetic flux induced by the primary coil 103 to bypass the leg 108 and, hence, bypass secondary coil 104. Thus, a relatively constant emf output at the secondary can be achieved by appropriately selecting the torque provided by spring 109 relative to the desired secondary output. In this connection, means are provided, such as the adjustment screw 116, for varying the torque provided by such spring.

The automatic voltage regulation arrangement of this embodiment can be used to correct not only for changes in the load connected to the secondary, but also for changes in the primary. That is, by adjusting the torque of spring 109 to position the switch 106 at, for example, the location indicated in phantom in which the switch directs a portion of the flux produced by the primary through the bypass leg when the desired secondary output is being achieved, any reduction or increase in the flux flow due to variations in the primary will cause the solenoid-plunger arrangement to rotate the switch 106 in the appropriate direction for correcting the same. Thus, this embodiment of the transformer of the invention is useful as a protective device isolating a load from a primary voltage which might vary.

Several embodiments of the invention have been illustrated and described in detail to demonstrate that the features of the invention are applicable to various configurations and types of variable flux transformers. However, such embodiments are not to be considered limiting. It is intended that the coverage afforded applicant be limited only by the language of the claims and its equivalent.

I claim:

1. A variable flux transformer comprising:

A. a transformer core of a magnetic flux-conductive material having at least three legs extending from a common crossbar, which legs terminate at free ends spaced from one another;

B. a primary electrical coil interactively associated with a first one of said core legs to generate magnetic flux therein, the free end of said first leg terminating at a location beyond the terminus of said second and third legs;

C. a secondary electrical coil interactively associated with a second one of said core legs for the inducement in said coil of an electromotive force in response to a magnetic flux flow change in said second leg; and D. a rotary magnetic flux path control switch of a magnetic flux-conductive material mounted adjacent said free ends of said legs for continuously variable rotary positioning relative to the ends of said legs selectively bridging the spacing therebetween to complete essentially an infinite number of differing low reluctance paths for flow of magnetic flux generated in said first leg through said second leg interactively by said secondary electrical coil and through said third leg bypassing said secondary electrical coil, said control switch:

(1) being rotatable from a first end position connecting said first leg with said second leg completely bypassing said third leg to a second position connecting said first leg with said third leg completely bypassing said second leg;

(2) including a first leg contacting surface which remains in flux connecting contact with the end of said first leg on rotation of said switch between said first and second end positions; and (3) including a lobe extension providing a second leg end contacting surface separate from said first leg end contacting surface, which second contacting surface moves between said second and third legs to connect said first leg respectively with said second and third legs upon rotation of said switch from said first to said second end position; and (4) having an axis of rotation positioned closer to the free end of said first leg than to the free ends of said second and third legs.

2. A variable flux transformer according to claim 1 wherein said primary and secondary electrical coils respectively surround said first and second core legs, and each of said first and second legs tapers inwardly toward its free end and has a cross-sectional area and shape from its free end to the location thereon of its associated coil accommodating the insertion of said coil over said free end and the passage thereof along said leg to said location during assembly of said transformer.

* * * * *